US005155944A

United States Patent [19]

Nagel et al.

[11] Patent Number: 5,155,944

[45] Date of Patent: Oct. 20, 1992

[54] METHOD AND APPARATUS FOR HONING WORKPIECES

[75] Inventors: Peter Nagel, Neuffen; Wolf Nagel, Nuertingen-Zizishausen, both of Fed. Rep. of Germany

[73] Assignee: Nagel Maschinen-Und Werkzeugfabrik GmbH, Fed. Rep. of Germany

[21] Appl. No.: 700,074

[22] Filed: May 3, 1991

Related U.S. Application Data

[63] Continuation of Ser. No. 269,241, Nov. 9, 1988, abandoned.

[30] Foreign Application Priority Data

Nov. 10, 1987 [DE] Fed. Rep. of Germany ..... 3738074

[51] Int. Cl.[5] ..... B24B 33/02; B24B 33/08; B24B 49/06

[52] U.S. Cl. ..... 51/290; 51/165.91; 51/34 J

[58] Field of Search ..... 51/331, 338–340, 51/342, 344–346, 351–352, 262 R, 165.93

[56] References Cited

U.S. PATENT DOCUMENTS

| | | | |
|---|---|---|---|
| 2,105,024 | 1/1938 | Connor | 51/346 |
| 2,170,329 | 8/1979 | Hokle | 51/262 R |
| 2,315,062 | 3/1943 | Kline | 51/346 |
| 4,434,588 | 3/1984 | Wada et al. | 51/344 |
| 4,455,789 | 6/1984 | Gehring | 51/345 |

FOREIGN PATENT DOCUMENTS

| | | |
|---|---|---|
| 2460997 | 1/1984 | Fed. Rep. of Germany . |
| 736928 | 9/1955 | United Kingdom . |
| 1489968 | of 1977 | United Kingdom . |

*Primary Examiner*—Bruce M. Kisliuk
*Assistant Examiner*—Bryan Reichenbach
*Attorney, Agent, or Firm*—Pravel, Gambrell, Hewitt, Kimball & Kreiger

[57] ABSTRACT

A method and device for honing a workpiece surface to be machined to provide a finished size and surface configuration comprising a honing tool with adjustable honing elements, the elements having a cutting zone and a calibrating zone, and also comprising a guide element with a surface sized to the finished size of the workpiece surface such that on the cutting stroke of the tool the cutting zone performs the cut and the tool is guided by the movement of the calibrated zone through the guide element and the honed surface.

8 Claims, 1 Drawing Sheet

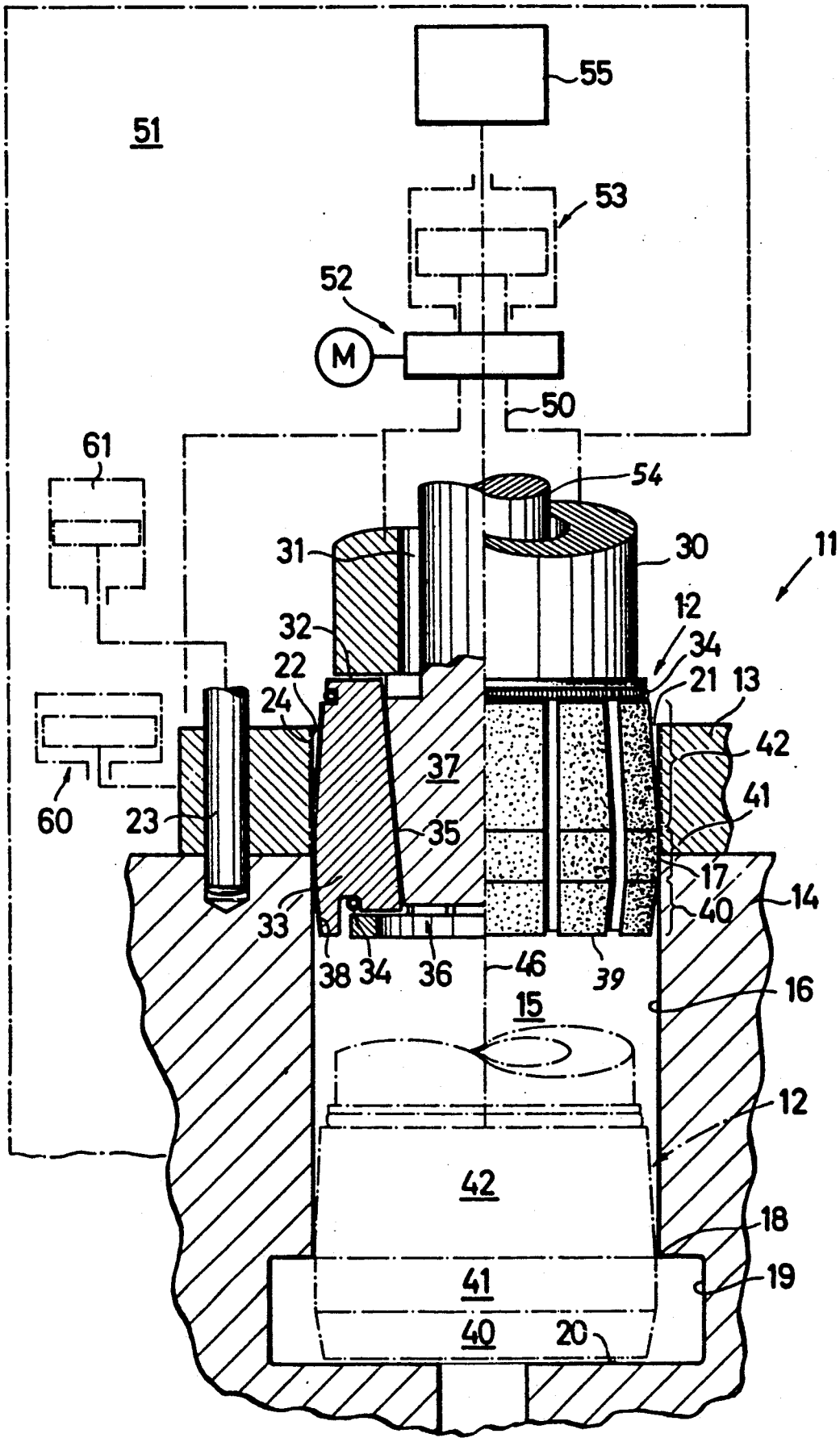
55
51
53
52
M
50
61
54
31
30
11
12
32
34
22
21
13
24
42
37
41
60
23
35
17
14
40
33
38
34
36
46
39
16
15
12
42
18
41
19
40
20

METHOD AND APPARATUS FOR HONING WORKPIECES

This is a continuation of Ser. No. 07/269,241 filed Nov. 9, 1988 now abandoned.

BACKGROUND OF THE INVENTION

1. Field of the Invention

The invention relates to a method and apparatus for honing workpieces and more particularly to a honing tool that can hone to the finished size in one stroke.

2. Background Information

German Patent 2,460,997 (United Kingdom Patent Specification 1 489 968) has disclosed a tool according to the preamble of claim 1. It is able to perform the main metal-removal function during honing in one stroke. Provided on its end located at the front in the working direction is a cylindrical or slightly conical guide zone which accurately aligns the tool relative to the workpiece and guides it during the cutting and calibrating operation, which take place one after the other in the longitudinal direction of the tool but partly simultaneously in time. However, the front guide zone necessitates a relatively long overrun of the front tool end beyond the end of the surface to be machined, since the tool, in order to correctly finish the machining, must have swept over the surface to be machined, at least up to the end of tis calibrating zone. This causes difficulties in blind bores.

SUMMARY OF THE INVENTION

The problem of machining blind bores with a honing tool working according to the method described has already been solved in German Offenlegungsschrift 3,537,009 and/or European Patent Application 0,219,825. In this application, the tool, with retracted honing layers, is moved into position into the machining area, the honing layers are set in accordance with the finished size and are held in this position during the machining ,which takes place during the return stroke. However, this method requires a setting mechanism which accurately sets the honing tool to the finished size. This necessitates increases mechanical effort compared with the tool according to German Offenlegungsschrift 2,460,997.

PREFERRED EMBODIMENT

The object of the invention is to create a tool which can also be used in difficult working conditions, in particular in blind bores, and does not need to impose high demands on the honing machine used for its application.

BRIEF DESCRIPTION OF THE DRAWINGS

The guide for guiding the tool relative to the bore is thus placed at a point at the beginning of and preferably outside the surface to be machined. The calibrating zone provided with the honing layer preferably takes over the boring function itself in interaction with a separate guide ring or a guide sleeve which is secured in a position aligned relative to the workpiece. Possible wear of this guide surface may be prevented by armor plating it. It can also serve, facultatively, as a ring gage or a reference surface which enables the honing layers to be adjusted directly or via a measuring device in order to compensate for abrasion and in particular to automatically adjust measuring instruments (determining zero position). An embodiment is preferred within which it is not the guide surface itself which forms the reference surface but a slightly set-back surface provided on the guide sleeve.

The guide surfaces can also interact with other parts of the tool body or its shank, in particular in tools in which the working surfaces of the honing layers, that is, the cutting and calibrating zone, lies in a fixed, aligned position relative to the tool body, that is, for example, in tools having a tubular tool body which carries the honing layers, facultatively expandable by slotting the tool body. In this arrangement, the guide element can be designed in the form of a sleeve which surrounds the tool body or shank between the honing layers and its clamping location on the honing spindle. The guide surfaces here can lie in a smaller diameter range than the nominal diameter of the tool bore.

The tool therefore no longer needs a front guide zone and can start virtually immediately with the conical cutting zone. A blind bore can therefore be machined almost right down to the end of the bore or to any other obstacles such as webs, etc.

Further advantages and features of preferred developments of the invention follow from the sub-claims and the description in connection with the drawings, it also being possible for these features to form a development or further development of the invention on their own or in combination with others. This also applies to use in similar or comparable tools or machining processes.

DETAILED DESCRIPTION OF THE PREFERRED EMBODIMENT

The drawing shows a partial cross-section through the fixture with the tool and a workpiece, the tool being indicated in a second working position by chain-dotted lines.

The fixture 11 shown in the drawing comprises a honing tool 12 which is to be attached to a honing spindle 50 of a schematically indicated honing machine 51. The honing spindle 50 is driven in a rotating manner by a drive 52 having an electric motor and can be moved up and down in axial direction of the honing spindle 50 to perform a stroke movement by a reciprocating drive 53, which is shown as hydraulic cylinder but can also consist of mechanical drives.

A drive rod 54 for an adjusting cone 37 of the honing tool has been accommodated inside the hollow honing spindle 50, between which a transmission means, for example a screw thread, can be inserted for converting a rotary movement into an axial movement. The drive rod 54 is actuated by an adjusting device 55 which can be present in the honing machine and, facultatively dependent upon the result of a dimensional check, can perform an adjustment to compensate for wear. However, the adjustment can also be carried out manually in a simple manner, since in the type of tool described below an adjustment is normally only necessary after a few hundred workpieces.

The honing tool 12 has a tool body 30 with an inner bore 31 which has radial slots 32 running in the axial direction. Guided in these slots 32 are honing strips 33 which are loaded toward the inside in a flexible manner at the top and bottom by one encircling coil spring 34 each. On the inside, they each have a sloping surface which widens toward the top and is part of an adjusting mechanism 36 which has an adjusting cone 37 on which the sloping surfaces 35 bear in a matching manner. As is typical in honing tools, the honing layers 38 on strips 33 are adjusted to expand or retract by axial movement of the adjusting cone which, due to the sloping surfaces 35, radially moves the strip 33 in the slots 32 against the force of the coil springs 34. On their outside, the honing strips have a honing layer 38 consisting, for example, of bonded diamond grain. The honing strips 33 and thus also the honing layer 38 extends down to the lower free end 39 of the honing tool 12. Starting at this location is a cutting zone 40 which increases conically or constantly in another manner from a diameter which is slightly smaller than the rough diameter of the bore not yet honed up to a calibrating zone 41 of substantially uniform diameter which corresponds to the finished diameter. Following this, likewise constantly, is a rear guide zone 42 which normally decreases again slightly in diameter and can be longer than the cutting and calibrating zone.

Furthermore, the fixture 11 has a guide element 13 which, in the exemplary embodiment shown, has the form of a ring which is subsequently to be attached directly in front of the entrance mouth 17 of the surface 16 of the bore 15 to be machined, and in fact accurately aligned relative to the workpiece 14. For this purpose, an index pin 23, for example, can be provided which engages into a matching bore in the workpiece 14 or some other device for accurate positioning. For this purpose, the honing machine contains a setting device 60 and an indexing device 61. The setting device 60 moves the guide element 13 toward the workpiece and the indexing device 61 fixes the exact position by engagement of the index pin 23 or a plurality of such elements. The indexing device and in particular the setting device can also be part of the clamping fixture for the workpiece 14.

It can be recognized that the surface of the workpiece bore 15 to be machined extends relatively close down to the bottom of the bore or an obstacle, e.g. an intermediate web of the bore protruding inwards. Close to the bottom 20 of the bore, the bore is provided with an undercut 19.

The guide element 13 has a bore which forms a guide surface 22 and is preferably provided with wear protection 24 in the form of an overall or surface hardening or in the form of an armor layer of wear-resistant materials or with a very fine, non-cutting diamond layer. It has the specified size so that the tool with its calibrating zone 41 is only guided, without cutting. The honing tool can be guided in a radially movable manner to a limited extent relative to the workpiece/guide element unit, e.g. by a tubular section having apertures, as is described in German Patent Specification 3,219,629, to which reference is made here, which tubular section is inserted into the honing spindle 50 and although rotationally fast is laterally flexible. The automatic alignment of the tool relative to the guide element by the latter and thus also relative to the workpiece is thereby facilitated.

The fixture according to the described exemplary embodiment of the invention performs the following operation:

The workpiece 14 is accommodated in a clamping fixture, and then the guide element 13, by means of the setting device 60 and the indexing device 61, is directly attached in an accurately positioned manner to the entrance mouth 17 of the bore 15 to be machined, so that the guide surface or bore 22 is exactly in alignment with the bore 15. The alignment corresponds with the nominal bore axis and need not necessarily also correspond exactly with the axis of the bore not yet machined. The fixture can thus correct axial positions to a certain extent.

The honing tool 12, with the effective diameter (diameter of the calibrating zone 41) firmly set to the finished diameter by expanding the honing layers as described above and blocking the cone 37 in its position, is moved into position from above by means of the reciprocating drive 53, first passes into the guide bore 22 and is accurately aligned and guided, the calibrating zone 41 interacting with the guide surface 22.

Under this accurate guidance, the tool passes into the unmachined bore 16, whose diameter is smaller than that of the calibrating zone or the guide surface by a few hundredths or thousandths of a millimeter. The honing tool therefore starts cutting with its conical cutting zone 40 exactly in accordance with the nominal axis and works its way into the bore 15 under constant rotary and reciprocating drive, the surface 16 to be machined being honed to the diameter of the calibrating zone 41.

When the tool has penetrated with the cutting zone 40 and the calibrating zone 41 into the workpiece bore 15, the guide surface 22 largely ceases to function as a guide, since the rear guide zone 42 then decreases slightly in diameter so that there is no longer any close guidance with the guide surface 22. It has been found that the tool, at least from this movement, develops guidance properties itself in interaction with the workpiece. The calibrating zone 41 and that part which is in engagement with the workpiece from the cutting zone 40 provide for good and adequate guidance. Thus longer workpiece bores can also be machined, although the tool is particularly suitable for short bores.

When the tool has reached the lower end 18 of the surface 16 to be machined and the calibrating zone 41 has finally overrun this line, machining of the surface 16 is virtually complete. The cutting and calibrating zone are located in the area of the undercut 19. If such an undercut is not possible for constructional reasons, the bore in the lower section can differ by a few hundredths or thousandths of a millimeter from the finished size of the rest of the bore. However, this area is restricted to a small length.

During the return stroke of the tool, with the tool continually rotating in the same direction, the calibrating zone again overruns the surface 16 being machined and insures finished machining, which in particular also provides the criss-cross texture typical of honing and important for the oil retention of the machined surface.

Many modifications of the exemplary embodiment shown are possible within the scope of the invention. Thus the guide surface 22, for example, could consist of a plurality of individual strips which are provided with wear-resistant coating or are made of such materials and which run in axial direction. The tool, instead of being designed as a strip tool, could be a shank, arbor or tubular tool, facultatively expandable. The expansion, instead of being provided by means of a cone, would also be provided by other expansion mechanisms, for example by a star-type rotary member. Furthermore, it has been explained that the guide surface 22, instead of interacting with the honing layer, could also interact with another tool surface, surface, for example the shank in the area of the upper part of the tool body 30. The guide elements could then consist of a sleeve which, facultatively, is also lifted along with the tool when the tool is moved out and is then accurately aligned again in a calibrating opening.

We claim:

1. Using a honing tool carrying honing elements, a method for honing a workpiece to a finished diameter in one stroke comprising adjusting a calibrating zone of the honing elements to the finished diameter, the calibrating zone having a substantially uniform diameter;

aligning a guide element relative to the nominal axis of the workpiece; and calibrating a guide surface of the guide element to the finished diameter; followed by placing the honing tool at one end of the workpiece such that the tool axis is aligned by the guide element and the calibrating zone is in contact with the guide surface; and rotating the honing elements; and followed by moving the tool past the workpiece.

2. The method of claim 1, wherein a stroke of the honing elements in the reverse direction to the initial stroke further configures the finished surface of the workpiece without substantial stock removal.

3. The method of claim 1 wherein the adjusting of the calibrating zone of the honing elements is performed subsequent to the calibrating of the guide surface of the guide element and said adjusting of the calibrating zone is performed while portions of the calibrating zone are juxtaposed to the guide surface of the guide element.

4. The method of claim 1 wherein the honing elements include a cutting zone that extends from a honing element leading edge that diverges from the workpiece surface in a direction lateral to the tool axis to the honing element calibrating zone that has a substantially uniform diameter.

5. The method of claim 4 wherein the honing element cutting zone is shorter than the honing element calibrating zone in axial length.

6. The method of claim 1 wherein moving the tool past the workpiece surface in an initial direction performs the main stock removal.

7. The method of claim 1 wherein the guide surface is comprised of the inner surface of a sleeve of the guide element, the diameter of the sleeve corresponding to the refinished size of the machined surface.

8. The method of claim 7 wherein the guide surface is provided with a wear protection layer.

* * * * *